United States Patent [19]

Nelson

[11] Patent Number: 4,795,298

[45] Date of Patent: Jan. 3, 1989

[54] MARINE TRANSPORTATION OF BULK CARGO

[76] Inventor: Arthur J. Nelson, c/o The Olympic Club, Lakeside 20, 524 Post St., San Francisco, Calif. 94012

[21] Appl. No.: 934,603

[22] Filed: Nov. 24, 1986

[51] Int. Cl.[4] ..... B65G 67/62; B63B 25/02; B63C 1/06

[52] U.S. Cl. ..... 414/140.8; 114/44; 405/6; 414/144; 414/143.2

[58] Field of Search ..... 114/44; 212/190, 191, 212/209; 405/1, 6, 218; 414/137, 139, 140, 144, 145

[56] References Cited

U.S. PATENT DOCUMENTS

| | | | |
|---|---|---|---|
| 1,122,546 | 12/1914 | Smith | 414/139 |
| 1,313,928 | 8/1919 | Stuart | 414/139 |
| 3,377,810 | 4/1968 | Crumley | 405/6 |
| 3,572,276 | 3/1971 | Skaarup | 414/145 X |
| 3,925,999 | 12/1975 | Andrew et al. | 405/6 |

FOREIGN PATENT DOCUMENTS

| | | | |
|---|---|---|---|
| 676521 | 7/1979 | U.S.S.R. | 414/137 |
| 944101 | 12/1963 | United Kingdom | 414/140 |

OTHER PUBLICATIONS

*International Cargo Handling Coordination Association Journal,* vol. VI, May 1959.

*Iron and Steel Engineer,* vol. 47, No. 6, Jun. 1970.

*Primary Examiner*—Robert J. Spar

*Assistant Examiner*—Janice Krizek

[57] ABSTRACT

An arrangement for loading and discharging cargo to and from a fleet of alike vessels in a timely sequence of arrivals between two terminals, organized to maintain a vessel's elevation at a constant position during the exchange of cargo to and from a vessel, with voyages completed by a passage in full draft condition with bulk cargo loaded holds to the discharge terminal and a return passage in ballast condition commensurate with deck cargo to the loading terminal.

3 Claims, 9 Drawing Sheets

278
314(A)
358
360
316(B)
336a
336b
364
362
318(C)1
316(B)
318(C)2
334a
334b
318(C)
334
64e
332
330
268
260
266c
200
80
264
32
270
262
320(D)
34
328
312f
30
8
112d
252d
256d
254d
116d
66d
70d
116c
136d
112e
252e
256e
254e
116e
66e
70e
224
136e

MARINE TRANSPORTATION OF BULK CARGO

BACKGROUND OF THE INVENTION (1) Field of the Invention

This application relies on hydraulic principles for handling vessels at terminals. Terminals, having frontages with navigable channels leading to the open sea, contain vessels in door closeable locks, accessible via dredged passageways from said channels. Hydraulically adjusted free surface of lock contained waters are monitored to establish the vessel constant elevational position in locks during load exchanges to and from the vessel suiting draft changes.

(2) Description of the Prior Art

Self-discharging vessels of the trade are generally self-propelled (steam or diesel driven) with the fleet comprising like or unlike characteristics in both vessel configuration and outfitting. The ordinary containment of propelling equipment aft results in various modes to elevate cargo from holds, generally relying on belt conveyor assemblies to dispose cargo to a fore or aft location between forepeak and engine room. A deck mounted boom contained conveyor transfers cargo to shoreside facilities.

To be practical, vessel sizes are elongated or built bigger for a corresponding increased problem to provide apparatus suiting more span and elevational consequences when vessels are in ballast condition and subject to tidal extremes.

Stiff competition between steamship companies exists, generally because equipment have no marked superiority and wages are too much more than foreign scale.

Unitrain concept for bulk cargo and containers for general cargo are largely terminal concepts to improve productivity. Terminals are compromised in arrangement suiting carriers of uncommon features for partial successes.

SUMMARY OF THE INVENTION

Objects of the invention are:

(1) to simplify means of handling cargo, lessening the movement of cargo and their conveyance means;

(2) to improve productivity by coordinating vessel and terminals, avoiding compromises, resorting to likenesses and interdependence of elements;

(3) to effect terminal compactness consistent with land value of properties in proximity of navigable channels;

(4) for arrangements lessening voyage time and suiting vessel trim and list containment;

(5) to obviate tidal affects;

(6) to resort to hydraulics with more efficient apparatus compatible with the marine environment;

(7) in an arrangement suiting transportation of hold disposed bulk cargo and deck load of trailers;

(8) in simultaneous handling of hold and deck cargo, to the timely exchange of hold cargo.

BRIEF DESCRIPTION OF DRAWINGS

FIG. 24*l*.—Pump piping diagram for the loading terminal.

This invention coordinates related aspects to transport goods (haul and handle) for marine concepts, a multi-faceted problem. Fortunately, there are considerable likenesses and repeating application of members and elements. Accordingly, likenesses are detailed at the outset for simple application to a specific element.

Elements are the vessel as constructed and outfitted, being pertinent to the other elements of discharge and loading terminals. In reverse order of ore handling, the primary cargo, the discharge terminal is first detailed as the simple arrangement, followed by the loading terminal.

FIGS. 9-13 depict types of valves indicating kinds of procurable valves, so are conventional means like gate valves with sliding member end check valves with clacks. All valve details are immaterial to their function in an arrangement.

Likenesses have been given a number to ease the recollection of a detail and use, depending on subscript letters identifying specific parts in figures. Accordingly, the discharge terminal is captioned as (d), understanding numerals read in the specification for discharge terminal automatically borrow the same subscript. The caption for the loading terminal (1) is similarly used. This means to localize members is used for specific segments of the specification; at times numerals bear subscripts as read to avoid confusion when elements are discussed in combination.

Figure 15:
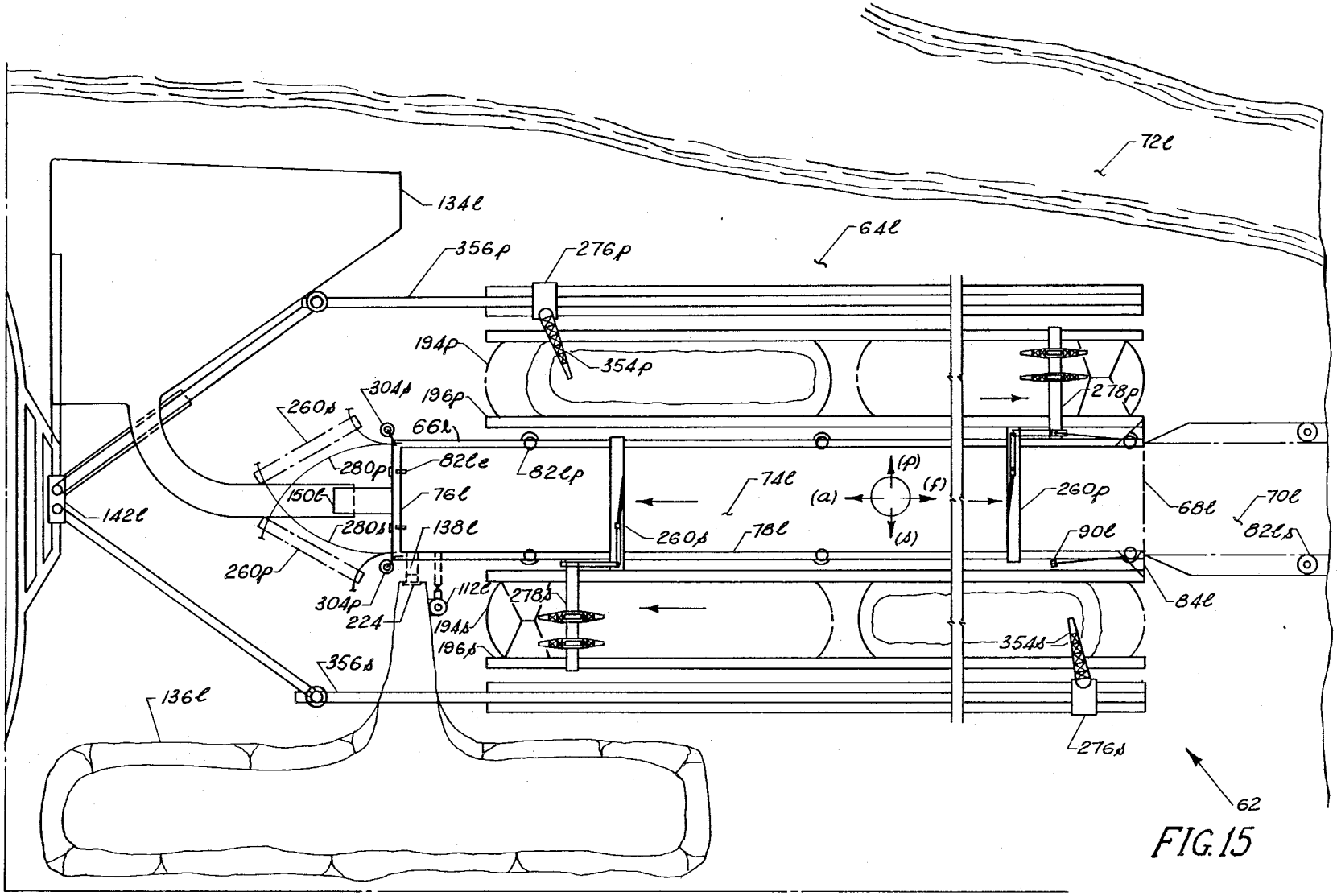
FIG. 15.—Plan view of the loading terminal general arrangement.

A rose has been included in FIG. 15 applicable for all figures to establish orientation of like members, suiting terminology of seamen as commonly understood: fore (f), aft (a), port (p), starboard (s), applied as subscripts to like parts with one number.

DESCRIPTION OF THE PREFERRED EMBODIMENT

Cross References - Prior Art:

(1) 4,275,677

(2) 4,553,497

(3) 4,5682,91

This disclosure relates to the conceivably largest vessel (Panamax) with more details needless to smaller sized vessels. Proprietary gear aboard the vessel is disregarded, relying on cross references for their coverage. Any bulk cargo conventionally transported is inferred from the simple term ore; used to distinguish hold contained cargo from containerized deck load, RO-RO trailers depicted.

Carrier vessels are identified as LT vessels 2 from cross reference "3". A feeder is defined as a tug in tow of an LT vessel. The fleet involving many feeders, circumstantial with the extended round trip voyage covered by distant passages between the loading and discharge terminal and annualized tonnage requirements, number one more LT vessel than tugs. An alternate lay-to of an inoperative LT vessel, discharging ore during the interim of a subsequent feeder arrival is afforded with the extra LT vessel 2.

This lay-to accommodates a discharge rate suiting a mill consumption, stockpiling ore only for emergency conditions; though that stockpile is regularly replenished as ore from it is recombined with current shipment for regular consumption to avoid aging consequences from prolonged exposure.

A voyage includes a return passage of an LT vessel 2 with a deck load of "RO-RO" trailers, placed simultaneous with ore discharge, for no added voyage time. Shipboard transportation of these trailers is an established "state of the art." Fixing of trailers to the vessel deck and manipulation of trailers between vessel and marshalling areas are known conventional practices.

The aspect of time is pertinent to operability of this arrangement being: travel time, trade-off of vessel at the discharge terminal and stop-over at the loading terminal; of itself consuming 9 hours (no trade-off) when the tug undergoes servicing for the pending voyage. LT vessels undergo servicing while at the discharge terminal.

Figure 2:
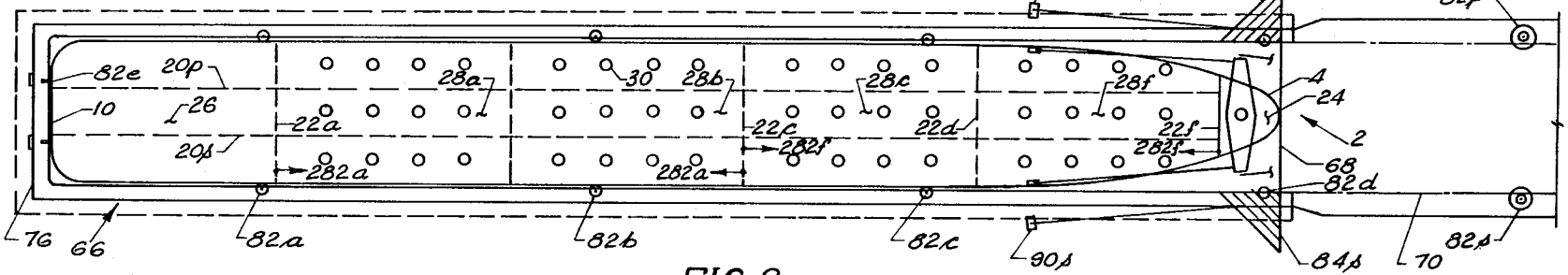
FIG. 2.—Plan view of FIG. 1
Figure 1:
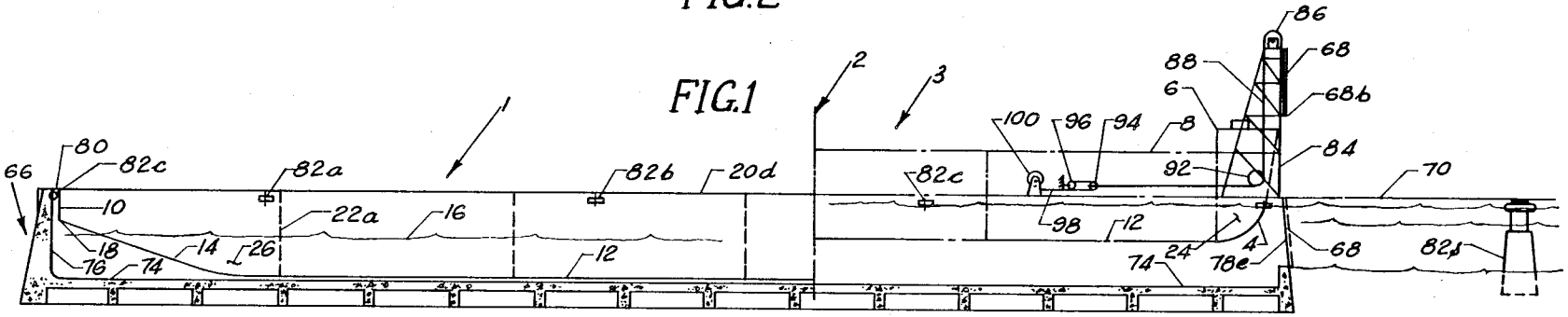
FIG. 1.—Elevational sectional view of a lock with an LT vessel contained therein.

LT vessels 2 (FIGS. 1, 2)

LT particulars, as an ore carrier, comprise: a ship-shaped forebody 4, superstructure 6, a freeboard deck 8 extending aft of the superstructure to a vertical plane transom 10. A keel 12, raked stern 14, extended a predetermined measure above full load water line DWL16, for junction 18 (for a raked transom stern) with transom 10 lower end.

The hull of LT vessel 2 is built with two longitudinal bulkheads 20 and five thwartwise bulkheads 22, isolating a forepeak 24 and afterpeak 26, to establish twelve individual water-tight holds 28. Each hold has four cylindrical hatches 30 with covers for a deck arrangement of three rows of sixteen aligned hatches. Rows of hatches center with freeboard deck passageways 32, free of trailers 34 disposed on freeboard deck 8.

Figure 7:
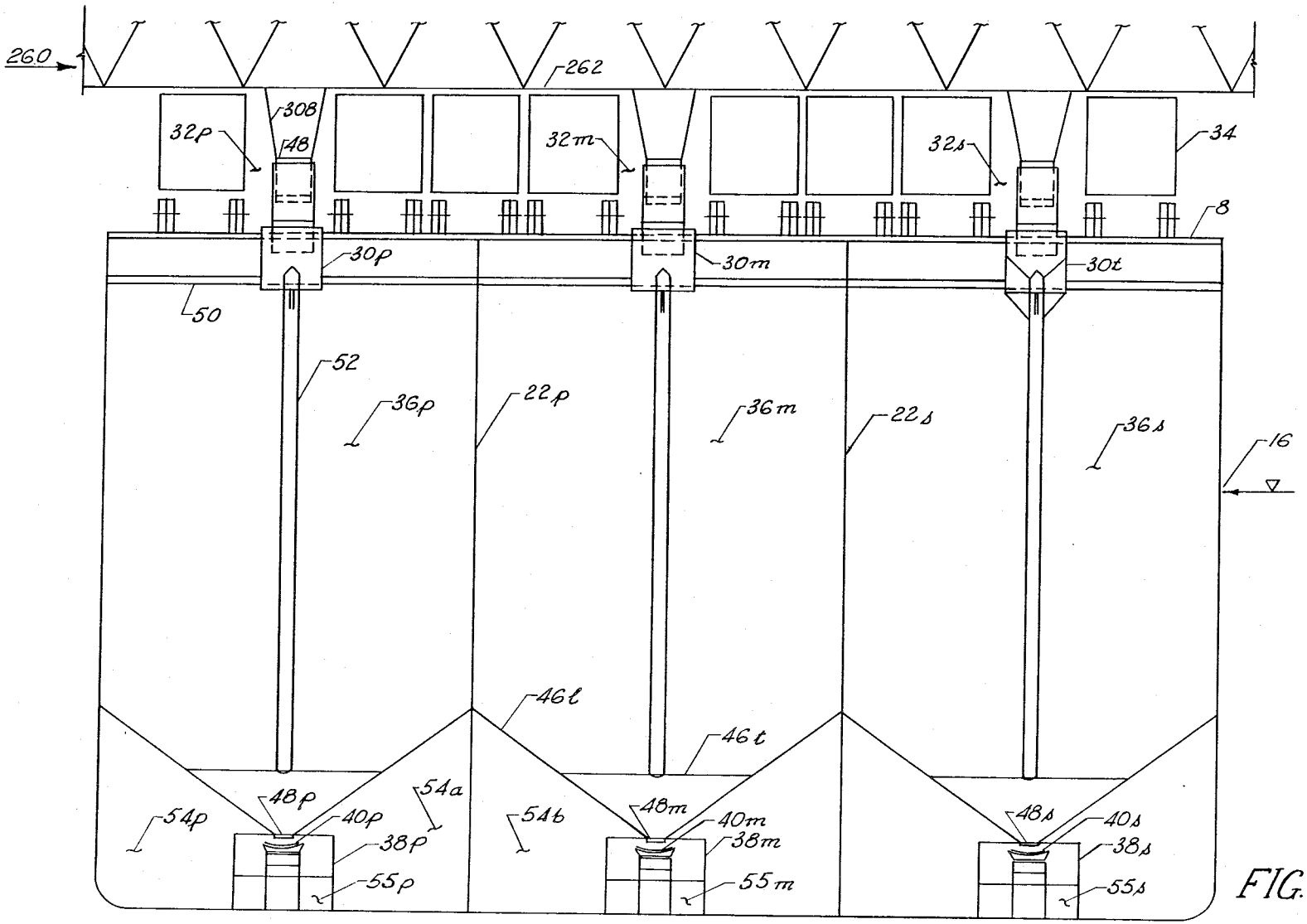
FIG. 7.—End diagrammatical view of an LT self-discharging ore carrier bearing deck cargo.

FIG. 7. Bulkheads 20 divide the hull of LT vessel 2 into three segmental holds 36, each hold 36 having a trunk 38 extending between bulkheads 22*a,f*, each trunk 38 having a singularly arranged continuous belt conveyor assembly 40 disposed parallel with the keel 12. Each conveyor reaching from the foremost bulkhead extends through an opening in said afterpeak 26 to approximately parallel said raked stern 14 (see FIG. 16) as a concave vertical curvature changed formed portion 40*c*, having an outboard doorway of the transom 10 fitted with watertight doors 42.

Hinge means 44, located inboard of said doorway, provide for the pivotal swing of the jackknife outboard assembly portion 40*e*. The conveyor pivotal portion is contained within the afterpeak 26 with doors 42 closed for the vessel at sea. This multiple arrangement of singular belt conveyor assemblies as parallel and individually integral units simplifies other arrangements to move ore horizontally in the hull, then vertically to a deck mounted boom belt assembly. Versions differ with manufacturers of means effected by separate and functionally different apparatus used serially.

Thwartwise bulkheads pierced for continuity of one belt are fitted with conventional guillotine type closures to retain watertight integrity of vessels at sea. Self-clearing holds 28 depend on having sloping surfaces 46 made steeper than the angle of repose of ore hauled. Ore thus falls to regularly located remotely controlled (pneumatically or hydraulically) conventional gates 48 for gravity feed of ore to belts.

Some forty gates, aligned over one belt, preclude the use of conventional skirt boards; so belts are selected to operate at about a third of its rating. Longitudinal bulkheads 20 provide intermediate support for continuous thwartwise girders 50 for deck 8 bearing trailers 34 of limited heights. Stanchions 52, indirectly connected to keel 12, provide deck support where penetrated by hatches 30 and halve span of girders 50.

Chambers 54 may contain liquid ballast or cargo as served by piping in alleys 55, with conventional pumping means contained in afterpeak 26 (shown sectioned for various purposes,) including dual rudder stocks staggering belt assemblies, panel-board with leads serving electric needs with power provided by the loading terminal and miscellaneous conventional means satisfying code. A Cross-Hinde type fitting forward, powered by cable from a tug, serves the vessel as an articulatively integrated unit per cross references. An auxiliary diesel generator set, automatically monitored at sea, maintains storage batteries serving navigational lights and means suiting code.

Buoyancy freeboard is the height of a vessel deck above design water line (DWL) 16. Draft is the immersion of a vessel keel below (DWL). Instead of the usual practice to rely entirely on elevating ore to suit vessel draft and tidal changes, this application adjusts the elevation of contained water surface for a fixed vessel relative position respective a graded area, adjusting ballast and water level as vessel loading changes.

Figure 16:
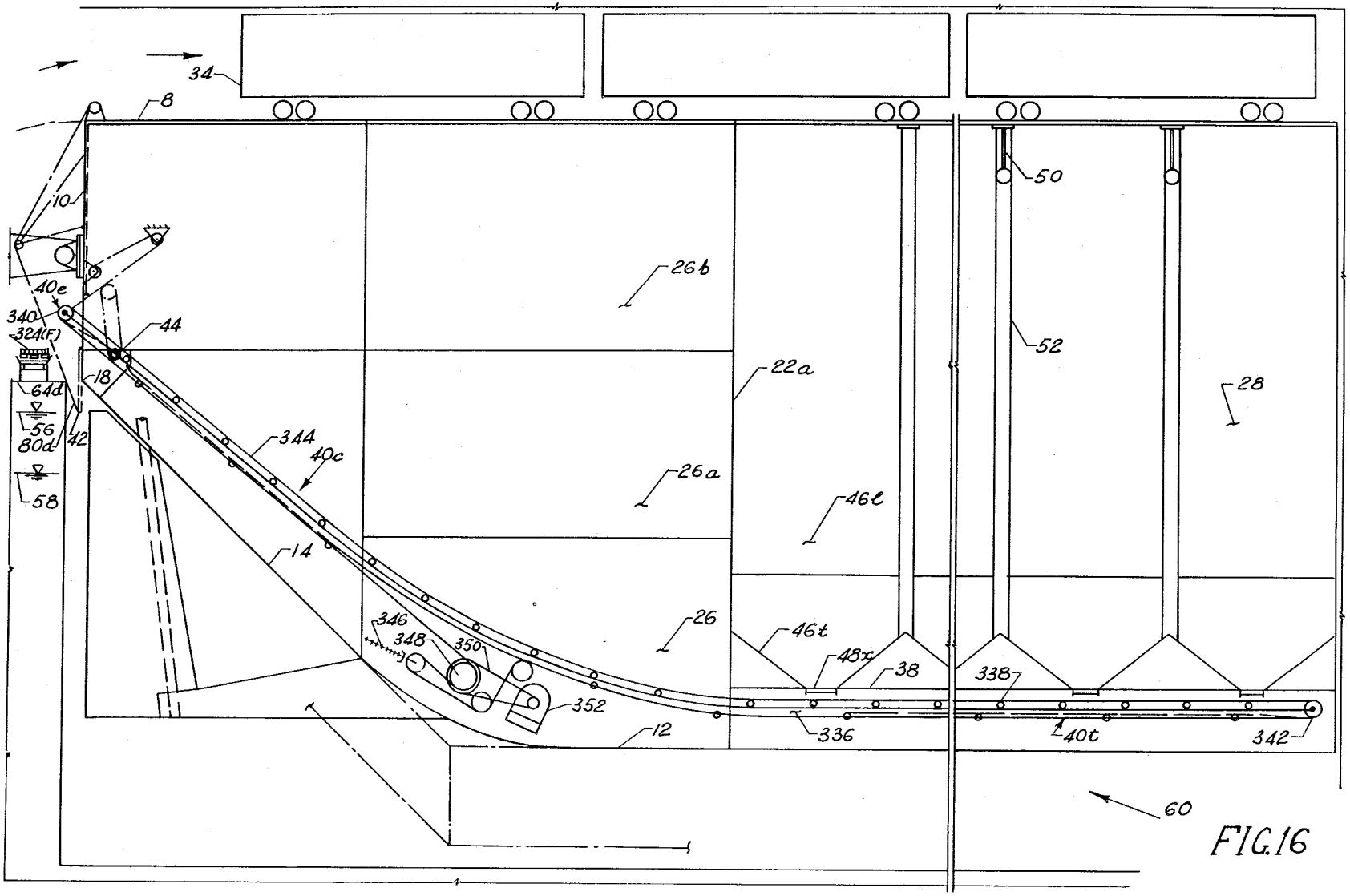
FIG. 16.—Side diagrammatical view of the aft portion of lock contained LT for the discharge terminal.

FIG. 16. Said predetermined measure of junction 18 above DWL 16 relates with a measured suitable elevation of a graded area above higher high water (HHW) 56. A local tidal range is the excess of (HHW) over lower low water (LLW) 58.

Figure 5:
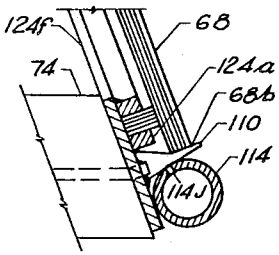
FIG. 5.—Partial sectional view of a lock door lower end seal and jet flush means.
Figure 8:
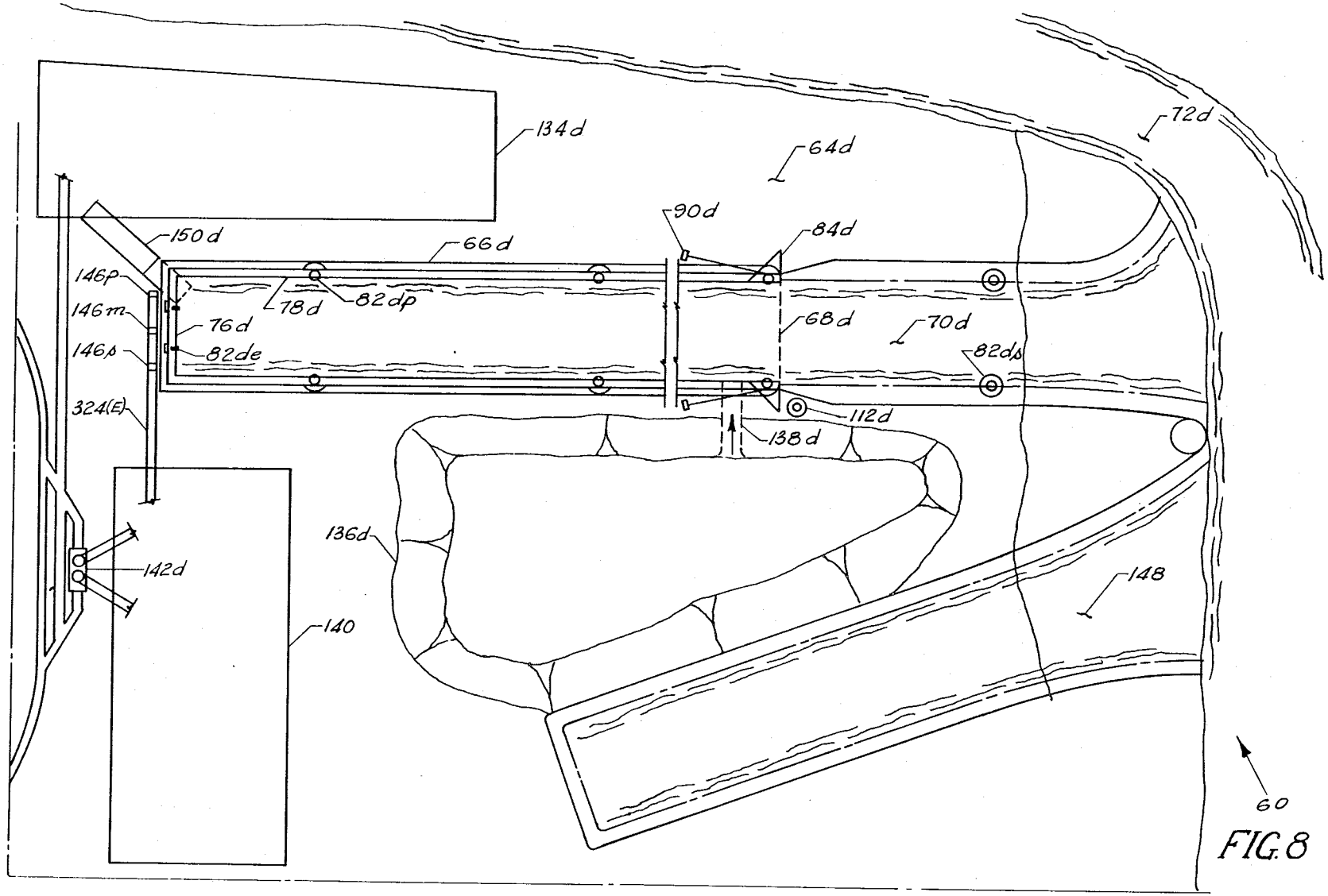
FIG. 8.—Plan view of the discharge terminal general arrangement.

Terminals (FIGS. 8, 5)

Discharge terminal 60 (FIG. 8) and loading terminal 62 (FIG. 15) have common features comprising:

(a) A graded area 64 said measurably above (HHW) 56 having a concreted lock 66, with said lock having a closable steel door 68, and is served by a dredged passageway 70 from a navigable channel 72 leading to the open sea. The lock has a floor 74, end wall 76 and two sidewalls 78 extended to contain the LT vessel 2 with doors 68 closed. Clearance gap 80 between the LT vessel and lock is minimized as managed by axial bearing mounted fenders 82 projecting from pockets in the lock walls, to continue the LT vessel guidance received in its sternward move through said dredged passageway, which has marketed tidal level floating fenders 82*p,s* constrained horizontally by their vertical axis embedded steel structure 82*s* seen in FIG. 1. Top of the lock 66 is level with the graded area 64.

(b) Towers 84 (FIGS. 1, 2)

Towers, supported by the graded area 64 and positioned at the lock open end faces 78*e*, extend a vertical height for a sheave 86 disposing cable 88 of hoist means 90, needed to raise the door bottom edge 68*b* to clear superstructure 6 of an LT in ballast condition with tidal condition at (HHW).

Hoist system 90 with each tower 84 comprising heavy cable 88, shackled at both ends to pin connect one end to top of doors 68, with cable 88 extended to reeve over top sheave 86, and then extend down to reeve with tower bottom sheave 92 for pin connecting the cable other end to tail block 94 of a conventional block and tackle means, having an anchored head block 96. Lead 98 off tail block 94 wraps to a drum powered by a gear motor 100, as a conventional hoist system.

Figure 4:
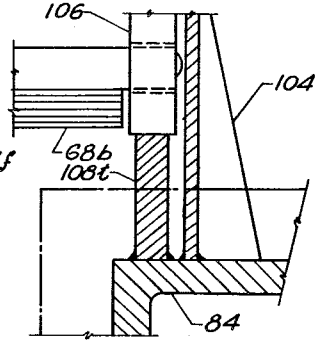
FIG. 4.—Partial sectional view of a lock door guided edge along the tower.
Figure 3:
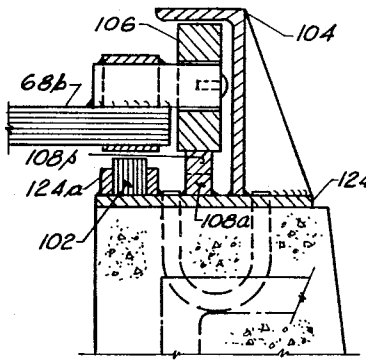
FIG. 3.—Partial sectional view of a lock door seal and guiding means.

(c) (FIGS. 3–5). Lock open end faces 78*e* are canted, bearing a sealing means 102 and channel guide arrangement 104, avoiding a sliding engagement of door and seal, for the door dead weight to contribute to the sealing force needed with differing water pressure on the door faces. Fixed to the door sides, near to its bottom edge, are roller means 106 bearing on rails 108*a*, extending the full length of the lock faces and continued along the tower as rails 108*t*, separating the door being moved from the seal. With the door edge 68*b* near to its stop 110, rail 108*a* is cam-like slotted 108*s* eliminating said separation, affording sealing of the door.

(d) Reservoir means 136, adjoining the graded area 64, have gravitational fluid flow disposed conduits 138, with closable valves connection with locks 66, for the rapid exchange of a large volume of water. FIG. 24 The pumping system 112 manifold includes conduit connection with reservoirs, to restore the reservoir function, affording volume of water exchanges between lock and reservoir.

At the loading terminal water is pumped from the "depressed" reservoir to waste and at the discharge terminal the "elevated" reservoir is refilled. The protracted time to service a reservoir affords a nominal pump size suiting other purposes as manifolded.

With approach of the door to said stop 110, pumping means 112 effects a jet action 114*j* of water from pipe 114 to flush away any contamination of the horizontally disposed seal 102. The door seal is not expected to be perfect with leakage of water into the lock as managed by the pumping system. The pumping system works intermittently, for leakage aspect as develops, with the allowable tolerance in fixed position of the vessel in a lock.

(e) Locks contain LTs to effect cargo exchanges to and from vessels, then being independent of tidal changes. Vessels are fixed elevationally within limits plus and minus 1" respective the graded area and top of the lock. (FIG. 24) A monitored pumping means 112 controls free water surface suiting changes with load aboard the vessel.

(f) Closeable doors 68 have slidable valves 116 opened to effect the rapid exchange of water to equalize water pressure on door faces. (FIG. 10) As in FIG. 3, the tux packing 102 is symbolic, as an arbitrary sealing means, simply supplanted; e.g., by round neoprene members. Shoulder 122 assumes full load on the door for a limited deformation of the sealing means. Valve details indicate procurable types. A catwalk 118, formed as a door top end strength member, provides access between side walls and to attend valve 116.

(g) A conventional marshalling area 134 has portable gear means for handling deck load 34.

(h) Deferred for a more cogent understanding is a jamb means which has a common purpose for both terminals. Mentioned now for recollection when detailed for the discharge terminal so as to apply for the loading terminal. This costly feature is needed briefly during a vessel's containment in locks as a door fixing means. Differential water pressure, acting to advantage, seals the door when the jamb is a redundancy.

(Mentionable now, also, is the lay-to practice avoided by the prior art as burdened by labor cost of their manned carriers. Lay-to also affords servicing of the LT vessel, particularly idle belt conveyor assemblies.)

General Arrangements

1. Discharge terminal 60 (FIGS. 8, 16) having as described:

(a) graded area 64 with lock 66 and dredged passageway 70*d;*

Figures 9, 10, 11, 12, 13, 14:
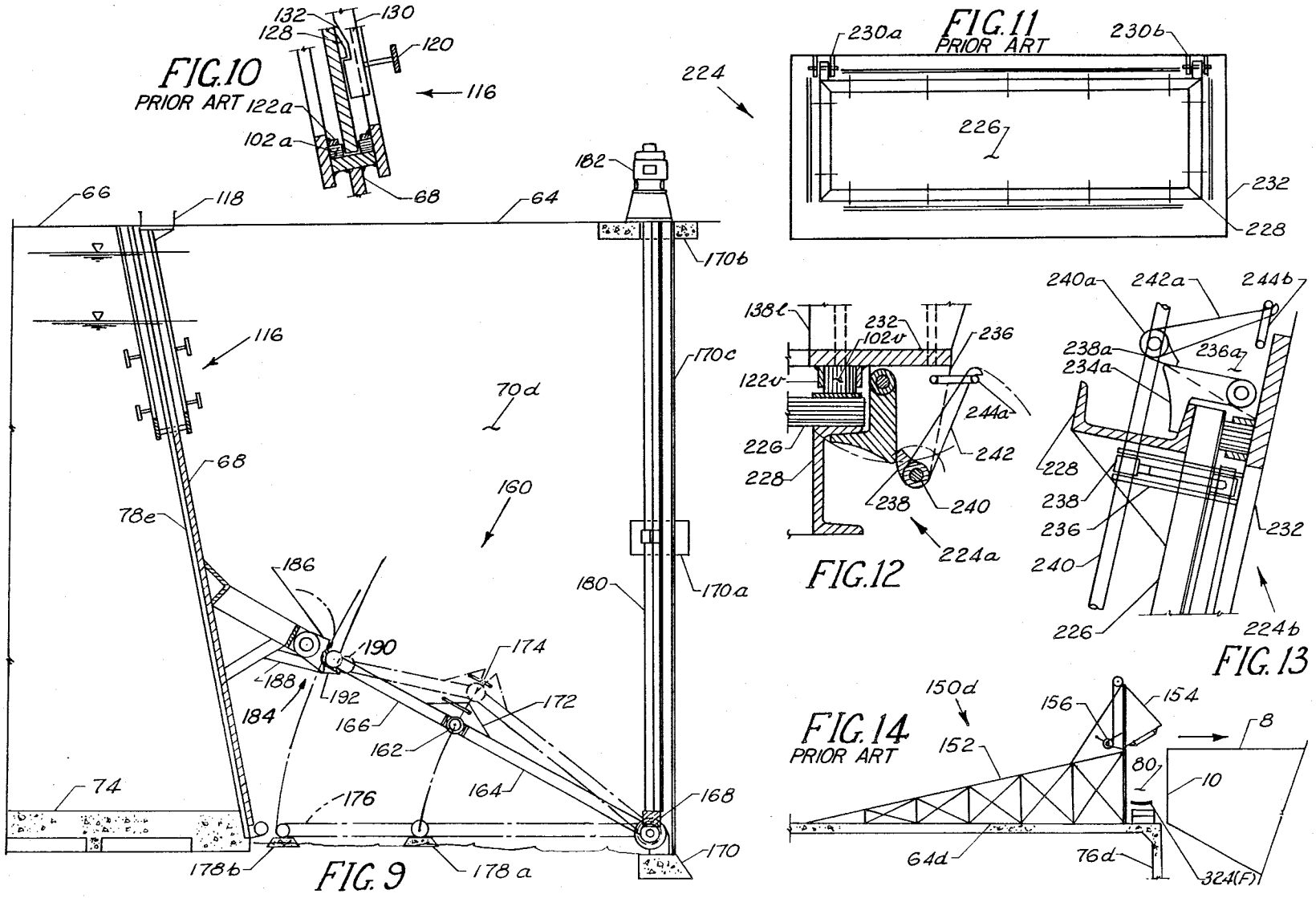
FIG.11 PRIOR ART
FIG.14 PRIOR ART
FIG.10 PRIOR ART
FIG. 9.—Side sectional view of a lock door arrangement including a jamb means.
FIG. 10.—Partial sectional view of a sliding valve, an enlargement of the valve indicated in FIG. 9. Conventional.
FIG. 11.—A front view of a flap valve serving a conduit for fluid flow between the lock and reservoir for the loading terminal. Conventional.
FIG. 12.—Partial end sectional view of the sealing means of flap valve of FIG. 11.
FIG. 13.—Partial side view of the sealing means of FIG. 12.
FIG. 14.—Schematic diagram of a ramp serving deck cargo transit means for the discharge terminal. Conventional.

(b) towers 84 with hoisting means 90;

(c) reservoir 136;

(d) marshalling area 134; and (e) further means comprising (1) an extended mill property 140 of grounds, buildings, public utility services, and equipment suiting a proprietary process to manufacture ingots;

(2) a trackage and unloading facility 142 serving the mill with supplementary materials and to augment trucks hauling deck load 34 for export;

(3) a shoreside belt conveyor assembly 324 disposed parallel and immediate to lock end walls 76, having three chutes 146, suiting LT vessel outboard arranged belt conveyor assemblies;

(4) a dredged temporary mooring 148 for an ore unloaded LT vessel 2, removed from the lock by a smaller service tug, minutes before the sternward reach to the dredged passageway 70 of a full draft ore loaded LT vessel for lock containment;

(5) Ramp 150 (FIG. 14);

a diagram of a loading ramp 150 is representative of conventional arrangements comprising, a suitable grade 152 to haul loads up (tractor return free), a hinged apron 154 and winch means 156 to selectively position the apron which spans the gap 80d and space for the shoreside belt conveyor assembly 324; and, (6) Jamb 160 (FIG. 9) with door 68;

effecting a toggle joint for increased pressure, jamb 160 comprises pin connector 162 of a pivotal frame member 164 and extending frame member 166. Both frames of pipe are foam filled, impervious to water, with frames effecting neutral buoyancy. Frame 164 pivoting end engages with bearing and worm gear mechanism 168 anchored to embedment 170. Frames assume alignment from shoulder means 172 and non-alignment with angular limit link 174. Frames extend the width of doors 68;

an inoperative jamb assumes a prone position 176 seen phantom like resting on embedments 178 which extend the width of door 68. The jamb is motivated by powered worm and screw means 168 at both ends of frame 164, relying on extended vertical shaft 180 to gear motor 182 set to graded area 64. Jamb bearing 184 to door 68 comprises: pivotal shoulder means 186, pin mounted to door framing, including backstop 188, limiting turning of shoulder means 186 for upward clearing position only; and, powering the jamb from prone position effects a non-aligned framing for the distal jamb end 190 to intercept an extended tongue 192, causing said clearing position of shoulder means 186. Further raising of jamb 160, frees shoulder 186 to return to backstop 188. Upon reversal of motor 182, jamb 160 engaging end 190 with shoulder 186, and as being powered, sets the jamb in alignment effecting a toggle action.

Figure 17:
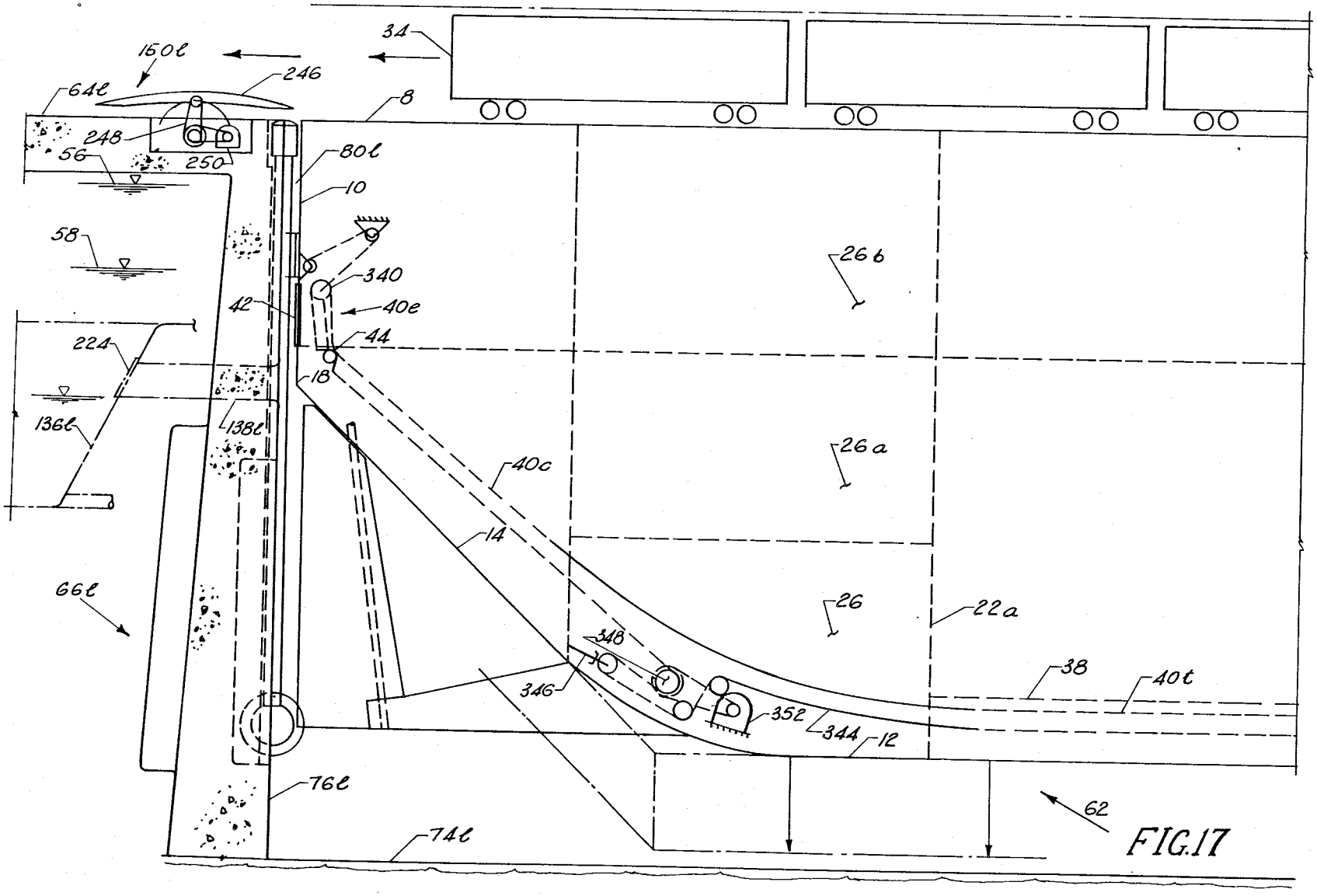
FIG. 17.—Side diagrammatical view of the aft portion of lock contained LT for the loading terminal.

2. Loading terminal 62 (FIGS. 15, 17) having as described:

(a) graded area 64 with lock 66 and dredged passageway 70;

(b) towers 84 with hoisting means 90;

(c) reservoir 136;

(d) marshalling area 134; and, (e) further means comprising:

(1) a unitrain trackage with unloading facility 142 and public utility services;

(2) an ore stockpile area 194 spaced from and to each side of lock 66 as contained by concrete bullwarks 196 extending the length of the stockpile;

(3) (FIGS. 6, 18) weldments 200 for lock 661, providing means subsequently disclosed, extends the full length atop both walls 78, comprising rails 198, angle 202, angle 204, angle 206, ribs 208, ribs 210 to be welded to soleplate 212, which is anchor set level with forms to concrete pour the top cap of walls 78. Ribs 208 reinforce angle leg 202 and ribs 210 extend that reinforcement to support angle 204. Bars 214 effect a slotted channel to contain a chain rack 216. Lumber 218, fixed to angle 204, effects a channel to contain cable 220. The fix of weldment 200 to soleplate 212 restricts thermal expansion changes, corrected by the water jacket 222 formed by angle 206 with rail 198;

(4) Flap valve 224 (FIGS. 11–13); (Conventional).

assembly 224 is comprised of plate 226, strengthened by perimeter channels 228, as hinged 230 to faceplate 232 anchored to canted end face of conduit 1361. Sealing means 102 is contained by members 122v for a rectangularly arranged containment of water. Details are merely indicative of conventional valves to the function;

(5) (FIG. 17) the unloading ramp 1501 is representative of conventional arrangements comprising: a crown 246, above a pit contained crank arm means 248, is powered by chain and sprocket connected gear motor 250. Said crank arm through its arc swing disposes the crown to span the gap between the LT vessel 2 and lock end wall 761 or withdraw the crown to rest clear of said gap.

Loading Terminal multi-conveyor arrangement (a) Bridges 260 (FIGS. 7, 18–20, 23)

Duplicate bridges, spanning the breadth of a lock, alternate relative positioning above successively contained LTs (FIG. 15).

Figures 18, 19, 20, 21P, 21S:
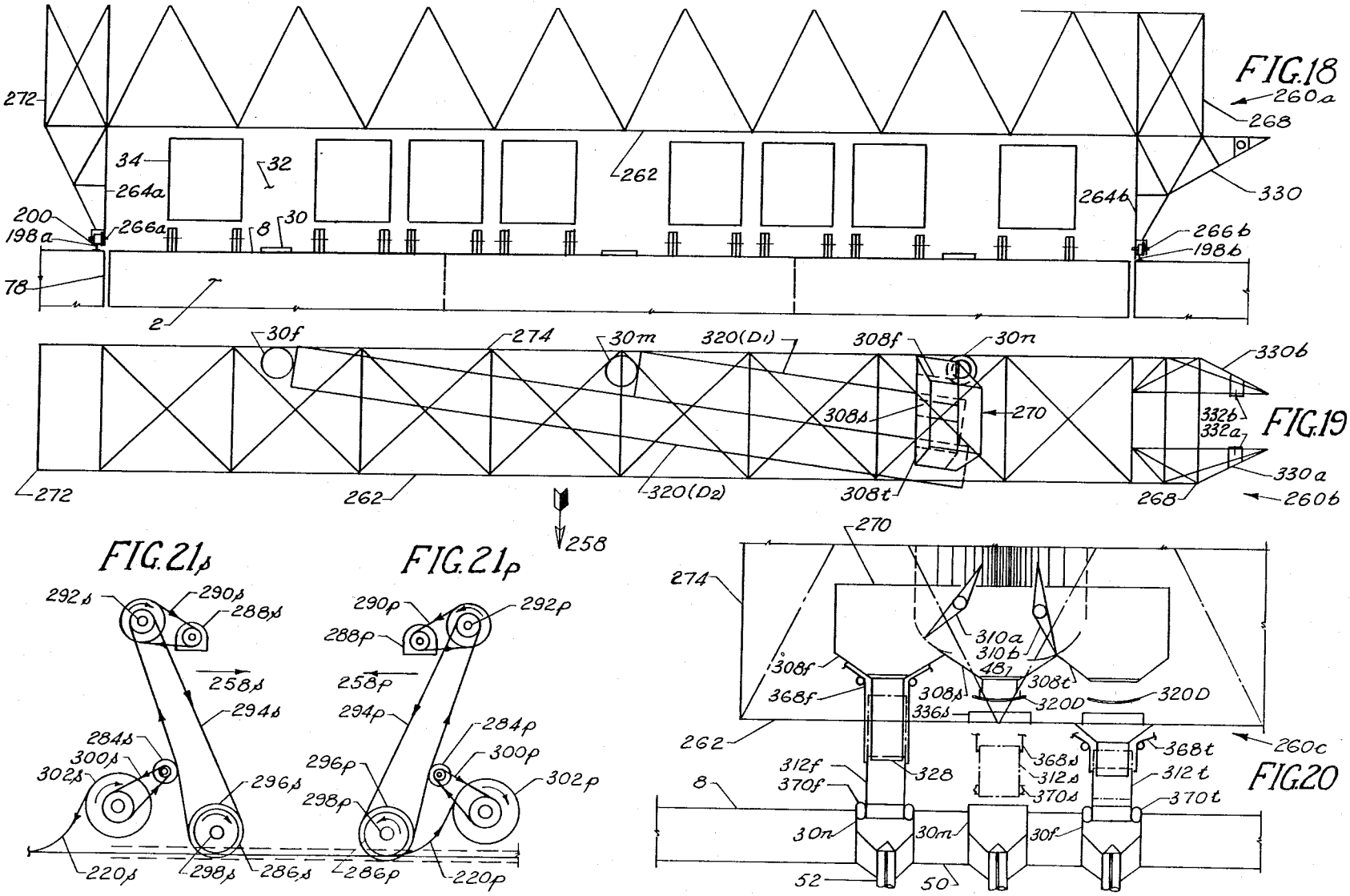
FIG. 18.—Elevational diagrammatical view of a bridge spanning the lock and clear of deck cargo on the LT.
FIG. 19.—Plan view of FIG. 18.
FIG. 20.—Elevational diagram of a bin, portioning cargo for simultaneous loading of three abreast holds.
FIGS. 21*s* and 21*p*.—Elevational diagram of a chain and sprocket serial arrangement for driving bridges.

Bridge 260, box shaped and extended bridge housing structure 262, has stiffleg ends 264 borne by wheels 266 running on rails 198f (FIG. 6), with the bridge housing structure 262 elevated to clear limited height deck load 34 (FIG. 18). (FIG. 19) At bridge one end 268, nearest the stockpile supplying ore for the bridge, a bin means 270 serves in the loading of holds. Oppositely is the bridge other end 272. A bridge back face 274, of the extended bridge housing structure 262, is its vertical walled structural members relating to a deck set of three abreast hatches 30.

Tractive power to a bridge is applied at both ends, using chain 216 (FIG. 6), as a rack, mounted in a self-clearing channel (plug free) for teeth of sprockets 286 to engage with chain rollers. (FIG. 21) A reversedly rotated motor 288 powers a first chain and sprocket arrangement 290 to drive a through shaft 292, extending over the bridge housing structure 262 to bridge ends, driving duplicate second chain and sprocket arrangement 294, with driven sprocket 296 thereof, mounted to stub shafts 298 which are bearing supported from stiffleg 264. Stub shafts 298 are extended for key mounting sprocket 286 engaged to rack 216.

Suiting the spaced apart sprockets of the second arrangement 294, idler sprockets 284, assembled for pivotal mounting to stiffleg 264, engages with chains of arrangement 294. The driving sprocket of a chain and sprocket third arrangement 300, made integratedly mounted with said idler sprocket 284, at said other end 272, serves to rotate reel 302. Electric cable 220, single row wrapped to reel 302 which is mounted to bridge other end 272, has a full length extendable from the power station 304, sided with the other end 272, to reach with the bridge to a most forward position on rails 198. Power take-off from the reel ended cable is conventional, for connection with a substation on the bridge for connection to motors thereon. Feed off or on of cable 220 exactly matches travel of the bridge, established by the common chain linkage and mechanisms involved.

Figure 6:
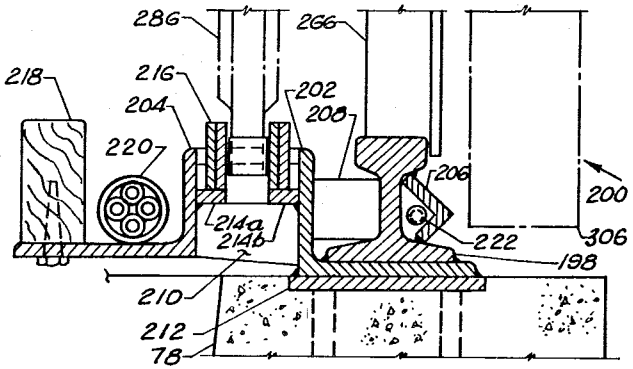
FIG. 6.—End sectional elevational view of a weldment fixed atop lock walls for the loading terminal.

The marine environment dictates encasing chain drives for a bottom sump partially immersed chain with daily runs to bath treat the entire chain. FIG. 6 shows encasement 306 with proximity to rail 198.

(b) Lettered identity of specific belt conveyor assemblies

| Identity | Disposition | Arrangement |
|---|---|---|
| 314 (A) | Reclaimer | bucket wheel feed |
| 316 (B) | Shuttle | reversible |
| 318 (C) | Pivotal | linked with (B) |

-continued

| Identity | Disposition | Arrangement |
|---|---|---|
| 320 (D) | Portional | bridge mounted |
| 322 (E) | Trunk | inboard/outboard head end |
| 324 (F) | Shoreside | fixed with locks |
| 326 (G) | Stacker | tripper |

All assemblies are conventional composites of selected purchased members: (see FIG. 16) troughing and return rollers, tail and head pulley, drive pulley (lagged), pulley arranged belt tensioning means, and discharge chute. Frames are foundation for members.

| | | Arrangements | | | | |
|---|---|---|---|---|---|---|
| | | Pulley | | | | |
| Array | Identity Frame | Tail | Head | Drive | Tension Means | Chute |
| (A) | fixed | x | x | x | x | x |
| (B) | Shuttle | x | x | x | x | dual |
| (C) | Pivotal | x | x | x | x | x |
| (D) | Fixed | Tension | — | x | — | x |
| (E) | Fixed & Pivotal | x | x | x | x | — |
| (F) | Switchable | x | x | x | x | triple-loading |
| (G) | Immaterial in detail. | | | | | |

(c) Dividing bin 270 (FIGS. 19, 20)

With the bridge located over a three hatch set 30, near to back face 274, hatches are identified as a near to (30*n*), midway of (30*m*), and far from (30*f*) said one end 268. Bin means 270, in the bridge housing structure, has a first chute 308*f*, a second chute 308*s*, and third chute 308*t* arranged bottom means, respective back face 274, for portioning ore discharged into the bin for three abreast holds.

FIG. 20 depicts vanes 310, made selectively adjustably positioned to intercept the trajectory of ore discharged from belt assembly 318(C), to vary ore quantity to each of the three chutes at the bottom of bin 270.

Telescopic funnels 312 fixed to bridge back face 274 are spotted to center with said deck passageway 32, each having funnel length adjusting means 368, positioning the funnel lower end into or clear of a hatch 30, enabling bridge 260 to travel unimpeded for successive said bridge locations over hatch sets 30. Funnel lower ends are fitted with external circumscribing rubber tubing 370, inflated to seal for emission control, with a registered nominal position of the funnel entry in hatches. The tolerance from said nominal position establishes the plus or minus one-inch limiting variance of said established elevational LT vessel positioning respective the lock 66 with the graded area 64.

A conduit means 328 connects said first chute 308(*f*) with the funnel 312(*f*) to be in sealed fit to said near to hatch 30(*n*) A belt conveyor assembly 320(D) with chute serves with said second chute 308(*s*) and the funnel 312(*s*) to be in sealed fit with said midway hatch 30(*m*). A longer belt conveyor assembly 320(D2) with chute 308 serves with said third chute 308(*t*) and the funnel 312(*t*) to be in sealed fit with said far hatch 30(*f*). A simultaneous loading is effected of three abreast holds. Hatches 30 have covers 30(*c*), bolt fixed with the vessel at sea and removed and replaced as hatches are freed, using conventional portable equipment manually operated. Decks have pneumatic and electric plug fittings.

Figures 22A, 22B, 23, 24D, 24E:
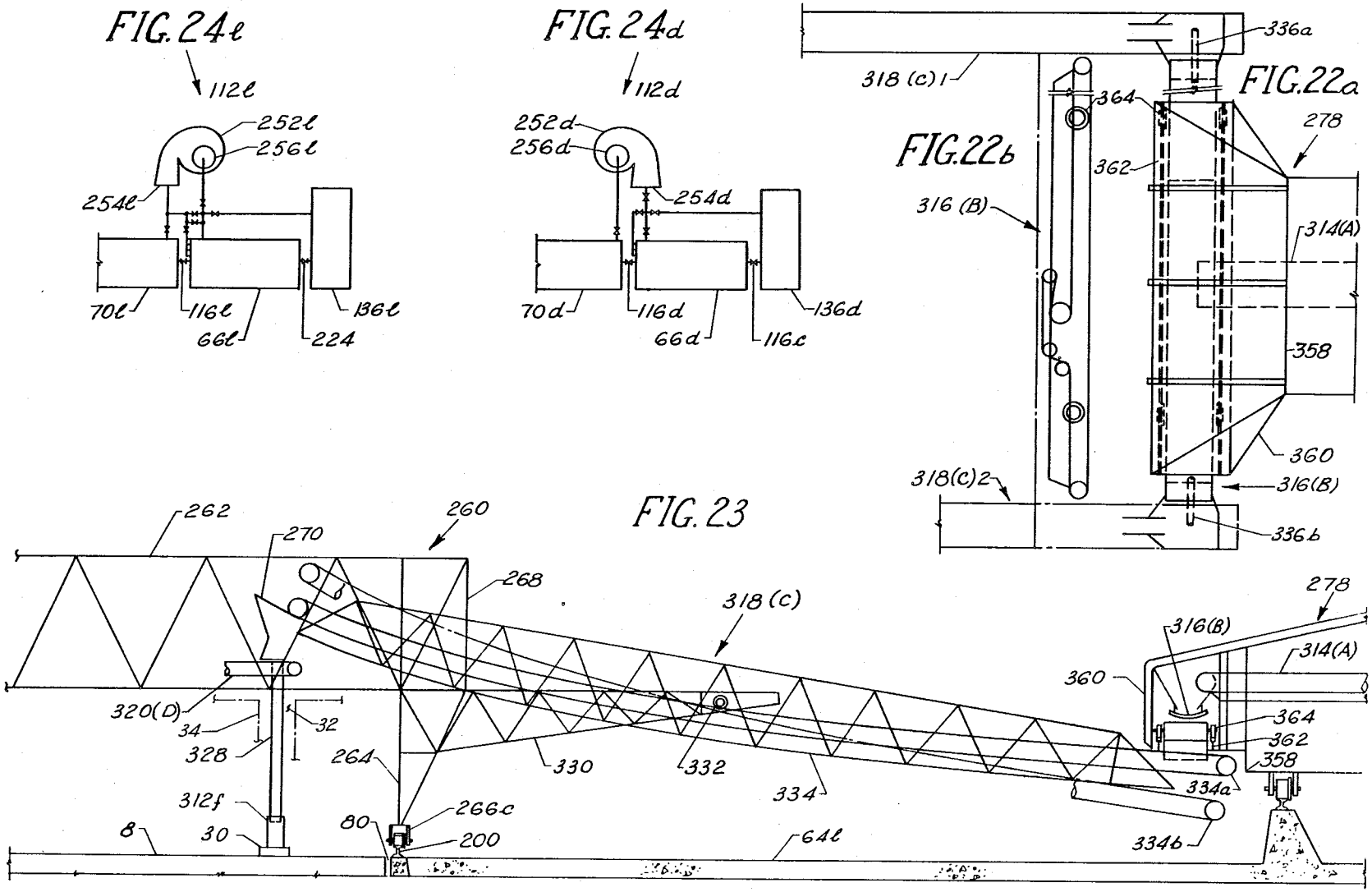
FIG. 22*a*.—Plan view of an appendage to a reclaimer to bear a shuttle conveyor selectively discharging from either end.
FIG. 22*b*.—Side view diagram of the shuttle conveyor (B) of FIG. 22*a*.
FIG. 23.—Side diagrammatical view of a concave vertical curvatured belt conveyor assembly (C) pivotally mounted to extend from the bridge to the reclaimer.
FIG. 24*d*.—Pump piping diagram for the discharge terminal.

(d) Bridge 260 with pivotal belt 318(C) (FIG. 23)

A cantilevered truss type appendage 330, from bridge one end 268, provides for an extended pivotal mounting means 332. Depending from mounting means 332 is a concave vertical curvatured formed belt conveyor assembly 319(C) with discharge chute providing for ore discharge to bin 270. Belt conveyor assembly 318(C), comprising a truss strengthened structure 334 constituting the basic frame to contain a conventional conveyor assembly, and roller chain with sprocket means transmitting power of a gear motor. Graphics of a conventional belt conveyor assembly are best seen in FIG. 16.

(e) Associated Equipment (FIG. 15) (Procured)

(1) Ore is loaded on the LT vessel from the two stockpiles, half segments of each taken. Stackers 276 are travelling trippers with boom mounted belt conveyor 354(*g*) having a discharge reach to the stockpile centerline, in arrangement with lengthy belt conveyor 356, extending from the unloading facility 142(1), the full length of the bulwark 196. The stacker repeatedly replenishes a segmental stockpile half load. With the stockpile contained by bullwark 196, the need to elevate ore is lessened from that of a free ore pile of like crossectional area, a more uniform recovery of ore occurs, the stockpile is more quickly and completely reclaimed.

(2) A reclaimer 278, for each stockpile in arrangement to alternately work segments of its stockpile, initiates recovering ore from the stockpile for transfer to its belt conveyor assembly 314(A).

The reclaimer 278 is equipped with two bucket wheels mounted on a carriage which travels back and forth on a bridge with wheels for tracks atop said bulwarks. Bucket wheels surround the bridge and buckets are reversible suiting the direction of travel along bullwarks. Ore picked up by buckets is discharged from its high point to a belt conveyor 314(A) mounted in the truss section of the reclaimer bridge.

Bucket wheels rotate as the reclaimer traverses the face of the stockpile, contacted by a harrow angularly set to rake ore loose to fall to the pile floor. With the bucket at a bulwark, the reclaimer moves an increment into the pile commensurate with the yield (T.P.H.) to oppositely cross the stockpile face. Each stockpile area covers a needed full LT vessel load, but only half the vessel load is received from each stockpile. Loading the vessel from two segmental stockpiles avoids list and uneven trim of the vessel and affords, while the vessel is being loaded from a remaining half pile, the restockpiling of the vacant area.

A reverse directional travel of the reclaimer into the stockpile, replaced while reclaiming ore for the previous vessel loading, establishes the need for said reversible buckets as well as the provision of dual harrows. Disclosure of a reclaimer is taken from literature by the manufacturer of the equipment.

(3) Reclaimer 278 Modification (FIGS. 22*a*, *b*)

Reclaimer bridge 278 with end 358, nearest with lock 66, bears an appendage 360 extending parallel with the lock in support of rails 362 for wheel 364 mounting a shuttle belt conveyor assembly 316(B) having chutes at both ends. FIG. 22*b* is an elevational view of assembly 316(B) assembled in appendage 360.

Of conventional members comprising assembly 316(B), gear motor means are, reversibly rotatable for a selective either end belt discharge of ore. As related, reclaimers 278 make steady progress initiating removal of ore from stockpiles. However, bridges are periodically stationary above a three set of hatches 30. Having fulfilled a load portion for a first said set with rubber tubing 370 deflated and funnels withdrawn, hatch covers are replaced for the bridge to advance quickly to the successive set of hatches, displaying non-uniform motion with the reclaimer.

Shuttle 316(B) comes into play having one end linked to the distal end of pivotal belt conveyor assembly 319(C). When a bridge makes its said advance, the shuttle belt conveyor assembly likewise advances (being towed) still receiving ore from belt assembly 314(A). A corresponding discharge of ore to belt assembly 318(C) is discharged to bin 270, storing ore contained by closed gates the short interval of time involved. Repositioned funnels and opening gates, remotely controlled, are exemplary of gates 48 associated with trunks 40 aboard LT vessels.

Linkage 336 is seen in a form with detail being incidental to its function and representative of any suitable arrangement. Examples: an inverted 'U' member fixed near to ends of shuttle conveyor 316(B) and a mating pin fixed near to the distal end of conveyor 318(C).

The pivotal feature of belt conveyor assembly 318(C) applies when its distal said linked end is changed to the shuttle belt conveyor assembly 316(B) opposite end. In changing connected ends, said distal end is depressed to clear the drive means disposed beneath the reversible driven shuttle belt conveyor assembly 316(B). This completed disclosure of the belt means to exchange cargo to load vessels relies on speed control.

Many years' experience of very large "Lakers" transporting coal and iron pellets has established programmed controls monitoring electric, hydraulic and pneumatic means operating gates regulating ore feed to belts.

Other conventional applicable means developed by industry apply with details immaterial to the function, with G.E. Co. as example: Selsyn Device CR9890, electric tie of motors 182; Electric Timer CR7504-A142, time delay; Lever, cam vane limit switch CR115A, position detector.

Hydraulic recoil brake means serve as dashpots for dampening vertical surges of vessels, applicable for flood exchange with locks. Elevational control of vessels to +/−1" limit in locks may use vane switch means, relying on plunger caused to rest on the deck of the vessel when engaged to vane switches, normally open, activate pump or valve means for adjustment of water level of ballast control of vessels. Means to control list or trim may include a pendulum vane to close magnetic said vanes listed.

Controlling the rate of an LT vessel 2 loading in tons per hour (T.P.H.) is arranged by the selected amount of incremental penetration of a stockpile by a reclaimer.

Operativeness of the Specification

1. Loading terminal 62(1)

(a) The sternway guided approach of a ballast conditioned LT vessel 2 through channel 70 with waters at HHW 56, for containment in lock 66 with doors 68 closed, establishes the maximum volume of water flood discharged from freeing flap valve 224 for gravity flow to "depressed" reservoir 136 through conduit 138. Rectangular conduit 138 having its lower wall located distantly below the graded area 64 equal to the freeboard of said vessel, establishing a free residual water level in the lock after said flood release, locating the vessel deck 8 level with the graded area 64. A conventional hydraulic means quickly dampens vessel surging, making effective, conventional control means monitoring deck elevational constancy to limits set for loading a vessel.

Vessel containment in the lock establishes a related deck orientation pertaining to stockpiles 194 of ore disposed to port and starboard of the lock. Stockpiles have a fore and aft segment, each to contain a vessel half load. A conventional stacker means 276 replenishes half loads to be recovered by a conventional reclaimer means 278 initiating ore transfer for an arrangement of belt conveyor means to the vessel.

(b) A simultaneous loading of a vessel from its two sides is performed by duplicate bridge loading means 260; caused to move over lock fixed rails 198 having a run the length of the lock, with a continuing level rail means set to the grade area 64 as curved extensions 280. As planned, each bridge 260 is associated with one reclaimer 278, effecting either a port or starboard vessel side loading; and, to maintain level trim, work directionally opposite of the other bridge in uniform stages of advance.

Reclaimers 276 are disposed between segmented stockpiles and with bridges about amidship above vessels to commence a loading. Bridges are powered to said curved rails 280 for return of the bridge last off the lock being the bridge last back on the lock; establishing a reversed relative bridge position with successive vessel containment. A bridge directional travel is established by the disposition, fore or aft, of segmental stockpiles worked by its reclaimer. For example: a compositely arranged starboard bridge, having its conveyor assembly 318C connected to conveyor assembly 316B of its reclaimer disposed to work the aft segmental stockpile, directionally travels aft; while the composite arranged port bridge counterpart, disposed to work the forward segmental stockpile, directionally travels forward; to load one vessel by reclaiming ore from two diagonally opposite segmental stockpiles. A second vessel is loaded from its two sides by bridges reversely said positioned for the composite starboard arrangement, being fed from the forward segmental stockpiles, directionally traveling forward and said counterpart then directionally traveling aft.

These repeating means of exchanged bridge positions suits the reclaimer means of working their fore and aft segmental stockpiles.

The LT vessel 2 hull of four sectioned three abreast holds 28 are loaded as two sections forward **282*f* and two sections aft 282*a***, each in eight stages of three abreast hatches. With the alternate positioning of bridges to one or other of two sections, a bridge's subsequent use involves the alternate section loading. (Deck load removal is unhindering to ore loading.)

To retain a vessel anti-list position, bridges have bin means 270 arranged to selectively portion the trajectory of ore discharged to the bin for collection in three chutes 308 having gates 48 automatically closed, with continuous feed of ore by said reclaimer means during the advanced positioning of bridges, timed from withdrawal of funnel means 312 fitted to a set of three abreast hatches 30 to positioning of said funnel means to a subsequent set; and, with opened gates, ore is contained by conveying means 320 between gates and funnels for three simultaneously loaded selectively portioned abreast holds 28.

(c) Said arrangement of conveyor means for each side loading of vessels comprising: a conveyor means 314(A), lengthened to extend between bulwarks 196, with an overhanging portion beyond a bulwark nearest the lock 66, with ore recovered by reclaimer means 278 between bulwarks for discharge from said overhanging portion, and having said conveyor means (A) supported to one position by said reclaimer means; including a shuttle conveyor means 316(B), disposed beneath said overhanging portion and roller supported by the reclaimer means, for conveyor means (B) lateral travel with and independent of the reclaimer means travel, for ore reception from means (A) over a designated portion of the lengthened means (B), having both ends selectively arranged for ore discharge; including a pivotal conveyor means 318(C), formed to a concave vertical curvature with the elevated discharge end affecting said trajectory to said bin 270, being pin support mounted 332 to an appendage 334 extension of the bridge 260, in right angle placement with means (B), with the means (C) distal lower end 334*b* disposed beneath means (B) for linkage 336 together in ore reception incidence, alternately to the dual discharge end arranged conveyor means (B).

Linking said conveyor assemblies (B) and (C) provides for the positioning for ore discharge from assembly (B) to assembly (C), suiting the regular progression of the reclaimer into a stockpile for each thwartwise pass of buckets recovering ore; versus, the more protracted and extended advances of a bridge position with abreast hatches; assembly (B) slidably mounted with the reclaimer and pivotally mounting assembly (C) accommodate alternately linking said distal end to either discharge end of assembly (B), arranged reversible, suiting ore recovery from segmental stockpiles and a bridge's alternate position serving subsequently arriving vessels.

(d) The noted continuous reclaimer means 278 travel, for complete loading vessels 2, and the repeating protracted fixed bridge position with a set of abreast hatches, followed by a matter of seconds, bridge travel to a next said set is managed by the link arranged tow of conveyor means (B) by pivotal means (C). Said lengthened shuttle conveyor means (B), accommodating by extension with reposition of bridge means, providing a said designated portion in ore receptive accommodation.

Immediately following full loading of vessels, bridges are withdrawn to curved rail means 280, whereupon preparations discussed may be effected for vessel departure. Similarly, bridges are disposed above vessels already established with said decks level with the graded area.

(e) Concerned for the lock door 68 pertains to the condition of water level differences to sides of the door, only when differential pressure acts outwardly tending to separate the door from its sealing means 102. The noted free water level, upon establishing said vessel deck level with graded area, is a gradual rising level until the DWL is reached with a loaded vessel, ordinarily becoming higher than LLW 58.

Therefore, though jamb means 160 was a redundancy to holding the door sealed with contained water level below prevailing tidal levels, the practice is to set the jamb before its need.

A loaded vessel departure follows opening valve means 116 allowing escape of lock contained water to the dredged passageway water at current tidal level, balancing water pressure to sides of the door. Then, further raising the jamb 160 free of shoulder 186, said door free of water pressure, is raised allowing the jamb 160 to be set to a prone position 176. During the interim of vessel arrival doors are lowered to closed position.

2. Feeders enroute

Sea time represents 92% of voyage time with utility of feeders understood from cross reference. Yet, a brief accounting of their redundancies and facility to adjust, suiting encounters, is relevant to the disclosure of specification for a coordinated arrangement of a fleet and terminal.

The example used for the specification resulted in a nineteen-day voyage for each of seven feeders, setting the 66-hour interim of feeder arrivals, noting the lay-to of a discharging LT vessel 2 is free of voyage time to self discharge cargo suiting a mill demand. The fleet of feeders with loaded and ballast vessels traveling in opposite directions effect several passes steered clear of others during a voyage. As provided with dual traction winches, tugs are able to effect double tow as regularly practiced for certain services. An ailing feeder then may be arranged for double tow by a passing tug, since designed CPP and diesel duty load at peak torque value indicates an allowable increased load to maximum continuous rating in emergency.

A vessel trails a pendant suspended from an extended aft boom, enabling the tug to transfer a crewmember, boarding the vessel to correct storm damage (lights required by code), or affected deck load to maintain a seaworthy tow.

3. Discharge terminal 60(D)

(a) The sternway guided approach of a loaded conditioned LT vessel 2 through channel 70, with waters at LLW 58 for containment in lock 66 with doors 68 closed, establishes the maximum volume of water to be flood discharged from "elevated" reservoir 136*d*. Controlled opening of valve 116(*c*) for gravity flow of water to lock 66 through conduit 138, raises contained free water level to HHW 56, effecting the LT vessel 2 said junction 18 level with said graded area. Arrangement for liquid level control (lowering as the vessel empties) for a fixed position vessel by monitoring means associated with the deck elevation, follows the disclosure for the loading terminal, again observing the immediate need to set the lock door jamb mean 160.

A lock least contained water occurs with a ballast vessel emptied of ore, depending on door valve 116 opening to flood the lock to establish a current tidal level, balancing water pressure to sides of doors to be opened. The timed arrangement, following discharge of ore, introduces a smaller terminal tug to move the unloaded vessel to a temporary mooring 148, clearing way with the immediacy of an arriving loaded vessel's entry to said dredged passageway 70 for a repeated vessel discharge. The feeder tug undertakes the trade-off practice for a return ballast LT passage to the loading terminal 62.

(b) A vessel's singular belt conveyor system 322(E) establishes the concept of a transom 10 means of ore discharge, suiting its lock 66 containment. The vessel arrangement of twelve holds 28, between a fore and aft peak 24,26, in sets of three abreast segmental holds 28, establishes four aligned holds with sixteen deck hatches 30 (determining the number of bridge steps with said abreast three hatches; bridges each effect eight steps per vessel loading).

Hatches center with its hold as do trunks 38 extended between the fore and aft peak 24,26. Each trunk contains a centrally disposed belt conveyor assembly 40(*t*), parallel above the vessel keel 12, with thwartwise bulkheads 22 pierced to contain the continuous belt to emerge into the afterpeak 26. Therefrom said singular assembly is formed to a concave vertical curvature 40(*c*) approximately paralleling the raked stern 14 to emerge the discharge end portion of said assembly 322(E) through doorways of transoms having closable watertight doors 42.

Curvature radius of belts exceed 300 feet with curvature radius of little more than 100 feet for the confluence of keel 12 and stern rake 14, adding space between the conveyor and vessel, to contain power means 352 and belt tensioning 346 of the assembly 322(E). A hinge means 44 mounted to the afterpeak 26 near to said doors 42 accommodates the pivotal swing through said doorway to jackknife said end portion 40(s) for containment behind watertight closed doors 42 at sea.

A said singular belt conveyor assembly 322(E) conventionally comprising: head and tail bearing mounted pulleys, troughing and return rollers including belt training elements, said tensioning and power means and trunk contained frames to which assembly members are mounted. A single belt serves each one assembly 322(E), having forty gates 48, remotely controlled, for a gravity feed of ore to belts loaded at about a third of its rating.

Outboard positioning of said jackknife portion 40(*e*) follows stabilizing of said deck level, having its plus and minus one-inch limit determined by the containment of the singular belt assembly (E) fit with chutes of shrouded belt assembly (F). While the intended discharge is alternatively by a single belt assembly (E) suiting a plant demand, all three belts may discharge simultaneously to the shoreside belt of adequate capacity. Any further demand increase requires the addition of a feeder.

4. Hydraulics (a) At the discharge terminal 60 (FIG. 16), the minimum volume of water is contained with the lock 66*d*enclosure of a full draft LT vessel with lower low water (LLW) 58 tidal conditions. A required LT vessel position is with its junction 18 made level; by raising the lock contained water to (HHW) 56 level to which the graded area 64*d* level is suitably above.

The volume of water gravitationally discharged, from the "elevated" constructed reservoir 136*d* to lock 66*d*, is governed by the tidal level when enclosing LT vessel 2. Before the need to release reservoir stored water to the lock, jamb mechanism 160 will have been set to brace door 68*d*, impressing the door against seal facing 102*d*.

Arrangement of a slidable said closable valve fixed to the face of conduit 136*d* is depicted by FIG. 10 and identifiable as 116*c*, as described earlier with use by door 68. Total volume of water enclosed by lock 66*d* is markedly less than of lock 66*l*. Sliding value 116*c* for lock 66*d* necessarily is measurably opened and closed to limit the volume discharged. An excess flooding of lock 66*d* is only objectionable as waste. Observing hydraulic needs after as LT vessel departs a lock, is to replenish water drained from reservoir 136*d*, and drain reservoir 1361, depending on pumping manifold systems 112 of FIG. 24.

(b) Pump Manifold Systems (FIG. 241, *d*)

System 1221 for the loading terminal FIG. 241 and 112*d* discharge terminal FIG. 24*d* as labelled with pump 252 having discharge 254 and suction 256 are self evident in particular performance with selective opening of valves (closing others).

At the loading terminal 62 (FIG. 17), the maximum volume of water to be exchanged has been contained with the lock 661 enclosure of a ballast LT vessel at (HHW) 56 tidal conditon. The vessel deck 8 is made level with the top of the lock at graded area 64 by freeing flap valve 224 to gravitationally discharge water from the lock to "depressed" constructed reservoir 1361. The conduit 1381 lower surface is measurably below the top of the lock by the freeboard of the ballast LT vessel to establish a residual water level.

5. Deck cargo; RO-RO trailers

Loading of trailers on vessel decks at the ore discharge terminal transpires over the lay-to period noted, suiting the more time consuming process of securing trailers for vessels at sea. This loading establishes a required ballast condition noted. The required ramp built to proper grade manages the transom height above graded area.

Off-loading of trailers from a vessel deck level with the graded area at the ore loading terminal is more simply effected with the number of tractors hauling trailers suiting the need for a cleared deck in the time to load ore.

Bridge heights clear trailers and funnel means, adjustedly elevated to clear a hatch cover accommodates unimpeded bridge travel above vessels.

The specification purposely dealt with the largest vessel (Panamax), understanding its more complete disclosure was illustrative of a smaller vessel; e.g., having any number less holds and fewer associated member means. Claims with antecedents from the preferred embodiment consequently are representative of values pertaining to quantities cited.

Obvious, too, is the mooring application of LT vessel 2 with said singularly arranged belt conveyor assembly to a docking means, providing a said shoreside means to be temporarily supported by the LT vessel and having a pivotal portion with a distal end mounted for sliding support on the dock accommodating tidal and vessel draft changes.

What is claimed:

1. For a voyage arrangement wherein there is made passages to transport cargo from a loading terminal by a self-discharging vessel to a discharge terminal and a return with the vessel in ballast condition, including vessel ore loading and discharging means, the combination comprising:

(a) a fleet of feeders having one or more (LT) carrier vessel than the number of tugs each with an (LT) vessel;

(b) (LT) vessels, having a junction effecting its raked transom stern, a free deck aft of an elevated forecastle superstructure, a hold unencumbered by propelling and engine powered steering means, and said transom, being a vertical plane surface extended above the design water line;

(c) longitudinal bulkheads divide said hold into abreast segmental holds, and thwardwise bulkheads establish a forepeak and afterpeak between which cargo is contained in an arrangement of individual watertight holds;

(d) trunks, disposed in said segmental holds, extend between the fore and aft said thwartwise bulkheads, have conventional guillotine type enclosing means fitted to thwartwise bulkheads, where pierced, to maintain watertight integrity of the LT at sea; said pierced bulkheads to provide for the continuous extension of the belt means contained in trunks;

(e) individual holds, having sloping surfaces for self-clearing of said ore, provide for gravity ore flow to conventional gate controlled openings to said trunks;

(f) said loading terminal having conventional stackers to replenish stockpiles of ore supplied during the interim of vessel arrivals and reclaimers to recover ore from stockpiles upon arrival of said ballast conditioned vessel;

(g) said discharge terminal having conventional shoreside cargo means to convey ore from said self-discharging vessel;

(h) a singular belt means, within each trunk and positioned beneath said gates, extend parallel with the keel from the foremost bulkhead to emerge into the afterpeak for form change to a concave vertical curvature, approximately paralleling said raked stern, for outboard extended ends through doorways in said transom;

(i) pivotal means, disposed within said afterpeak, affords a jackknife end portion of said singular belt means to be pivotally swung inboard, enabling doorways to be closed watertight for the vessel at sea;

(j) cylindrical hatches, penetrating said deck and disposed aligned above belt means, effect aligned abreast means to load segmental holds simultaneously;

the improvement for said loading terminal comprising:

(a) a graded area, having a lock means with top of its walls level with the graded area, a dredged passageway affording a vessel approach to the open end of the lock, a lock door when closed contains the vessel and buoyant supporting water to levels disposing the vessel deck level with the graded area during loading ore to the vessel;

(b) towers at open end walls of the lock, with hoisting means to raise said door to clear the superstructure of the ballast conditioned vessel's arrival with tide at higher high water;

(c) a jamb means to brace said door is disposed out of the lock, effective when lock contained water is higher than a tidal level;

(d) a depressed reservoir, receptive of said lock contained water, and a flap valve controlled conduit for gravity flood water flow from the lock to the reservoir, serves to establish a prescribed lock contained residual water level for a said deck made level with the graded area;

(e) a pumping system, in manifold arrangement with the lock and reservoir, when operable to selectively elevate said contained water level, effects draft increases with loading the vessel to maintain the same level with the grade area and is used to prolong draining the reservoir of water during interims of vessel arrivals to the terminal;

(f) stockpiles, spaced from and parallel with both sides of the lock, with bulwarks extending the length of the lock for containing ore and mounting said reclaimers, are divided into fore and aft segmental stockpiles, each segment containing a half vessel load;

(g) a shuttle conveyor assembly (B), slidingly supported by an appendage to the reclaimer and arranged to discharge from either end, is disposed to receive discharge of ore from a conveyor assembly (A), which spans between said bulwarks, to convey ore discharged by bucket wheels of the reclaimer;

(h) duplicate bridges, structurally extending with end stiff-legs having wheel mounting means for engagement with rails secured atop walls of the lock, include: a cantilevered structural appendage from one end of the bridge providing a pivotal mounting means, a conveyor assembly (C), formed to a concave vertical curvature supported by the pivotal mounting means, and having a bin disposed adjacent with said one end and receptive of ore discharge from conveyor assembly (C);

(i) bin means having bottoms with gate controlling chutes, conveying and telescopic funneling means, to provide ore discharge from bin to abreast hatches simultaneously;

(j) tractive means and cable means to power bridges with a fore and after travel above vessels contained in locks, and including means to have bridges alternately establish a reversed position above successive vessel arrivals, suiting its reclaimers occupation with a segmental stockpile;

(k) link means connecting the conveyor assembly (C) distal lower other end beneath and to one discharge end of shuttle conveyor assembly (B);

(l) pivotal mounting of conveyor assembly (C) accommodates linking said distal end alternately to opposite discharge ends of conveyor assembly (B), arranged reversible, to afford ore recovery from alternate segmental stockpiles and a bridge working subsequently arriving vessels; and, (m) said door is fitted with a valve means to flood release waters to equalize water levels to sides of the door to be opened, whereupon said jamb is disposed prone to clear passage of loaded vessels.

2. As in claim 1, the improvement for said discharge terminal comprising:

(a) a graded area, having a lock means with top of its walls level the graded area, a dredged passageway affording a vessel approach to the open end of the lock, a lock door when closed contains the vessel and buoyant supporting water to levels disposing said stern junction level with the graded area during discharging ore of the lay-to vessel;

(b) towers at open end walls of the lock, with hoisting means to raise said door to clear the superstructure of the ballast conditioned vessel's exit with tide at higher high water;

(c) a jamb means to brace said door is disposed out of the lock, made effective when lock contained water is higher than a tidal level;

(d) an elevated reservoir disposed above said lock contained water, and a valve controlled conduit for gravity flood water flow from the reservoir to the lock serves to establish a prescribed lock contained effective water level for a said junction made level with the graded area;

(e) a pumping system, in manifold arrangement with the lock and reservoir, when operable to selectively lower said contained water level, effecting draft decreases with discharging ore from the vessel to maintain said junction level with the graded area, and used to prolong refilling the reservoir of water during interims of vessel arrivals to the terminal; and, (f) said door is fitted with a valve means to flood release waters to equalize water levels to sides of the door to be opened, whereupon said jamb is disposed prone to clear passage of a loaded vessel.

3. As in claim 2, the improvement for bearing a deck load for said return passage, comprising:

(a) loading means at the discharge terminal, suiting the fixed elevated deck above the graded area, to haul trailers of limited height aboard the vessel as a deck load disposed to effect deck passageways centered by said hatches, fixing the loading in conventional manner and timely with said ore discharges; and, (b) unloading means at the loading terminal, suiting the level fix of the vessel deck with the graded area, to haul trailers off the deck, having bridges elevated higher than said limited height trailers to afford the simultaneous and timely loading of ore and removal of the deck load.

* * * * *